US006302197B1

(12) United States Patent
Hornby et al.

(10) Patent No.: US 6,302,197 B1
(45) Date of Patent: Oct. 16, 2001

(54) LOUVERED PLASTIC HEAT EXCHANGER

(75) Inventors: Randy John Hornby, Canton; Ajit Ravindra Shembekar, Farmington Hills; Brian Gene Makie, Warren, all of MI (US)

(73) Assignee: Isteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/469,804

(22) Filed: Dec. 22, 1999

(51) Int. Cl.[7] ..... F28F 9/02
(52) U.S. Cl. ..... 165/173; 165/175; 165/153
(58) Field of Search ..... 165/173, 148, 165/153, 175, 176

(56) References Cited

U.S. PATENT DOCUMENTS

Re. 33,528 * 1/1991 Doty ..... 165/173
3,112,793 * 12/1963 Sass ..... 165/175
3,648,768 * 3/1972 Scholl ..... 165/171
4,693,302 * 9/1987 Dodds ..... 165/905
4,799,540 * 1/1989 Pietzcker ..... 165/76
4,901,792 * 2/1990 Komiya ..... 165/175

FOREIGN PATENT DOCUMENTS 59-197753 * 4/1983 (JP) ..... 165/175

* cited by examiner

*Primary Examiner*—Ira S. Lazarus
*Assistant Examiner*—Terrell McKinnon
(74) *Attorney, Agent, or Firm*—Larry I. Shelton

(57) ABSTRACT

A louvered plastic heat exchanger includes a first manifold, a second manifold, and a plurality of louvered panels extending laterally between and in fluid communication with the first manifold and the second manifold. The louvered panels are spaced longitudinally and vertically and positioned at an angle off a direction of airflow therethrough.

18 Claims, 2 Drawing Sheets

LOUVERED PLASTIC HEAT EXCHANGER

BACKGROUND OF THE INVENTION

1. Field of the Invention

The present invention relates generally to heat exchangers and, more specifically, to a louvered plastic heat exchanger for a cooling system in a motor vehicle.

2. Description of the Related Art

It is known to provide a heat exchanger such as a radiator for a cooling system in a motor vehicle. The radiator receives a fluid such as a coolant, at a reasonably high temperature, and cools the coolant. Typically, the radiator includes a plurality of tubes forming a radiator core extending between opposite headers or end tanks mechanically attached to the radiator core. The radiator also includes a plurality of cooling fins disposed between the tubes. Typically, the tubes and headers are made of a metal material such as aluminum.

It is also known to manufacture the heat exchanger from a plastic material. An example of such a heat exchanger is disclosed in U.S. Pat. No. 5,469,915. In this patent, the heat exchanger has a plurality of parallel tubes in a spaced apart side-by-side relationship with the tubes being located between two plastic sheets. The tubes and sheets are made of a thermoplastic polymer. However, the sheets prevent the tubes from conducting direct heat exchange with the air.

Therefore, it is desirable to provide a plastic heat exchanger with a core made of tubes that conduct direct heat exchange with air. It is also desirable to provide a plastic heat exchanger with a louvered heat transfer surface. It is further desirable to provide a plastic heat exchanger that provides more packaging flexibility.

SUMMARY OF THE INVENTION

Accordingly, the present invention is a louvered plastic heat exchanger including a first manifold, a second manifold spaced from and opposing the first manifold, and a plurality of louvered panels extending laterally between and in fluid communication with the first manifold and the second manifold. The louvered panels are spaced longitudinally and vertically and positioned at an angle off a direction of airflow therethrough.

One advantage of the present invention is that a louvered plastic heat exchanger is provided for a motor vehicle. Another advantage of the present invention is that the louvered plastic heat exchanger has a core made of polymer tubes that are aligned in rows to create a louvered heat transfer surface. Yet another advantage of the present invention is that the louvered plastic heat exchanger provides heat exchange directly with air. Still another advantage of the present invention is that the louvered plastic heat exchanger has a polymer louvered tube core that optimizes air flow and heat transfer characteristics, while providing more packaging flexibility.

Other features and advantages of the present invention will be readily appreciated, as the same becomes better understood after reading the subsequent description taken in conjunction with the accompanying drawings.

DESCRIPTION OF THE PREFERRED EMBODIMENT(S)

Figure 1:
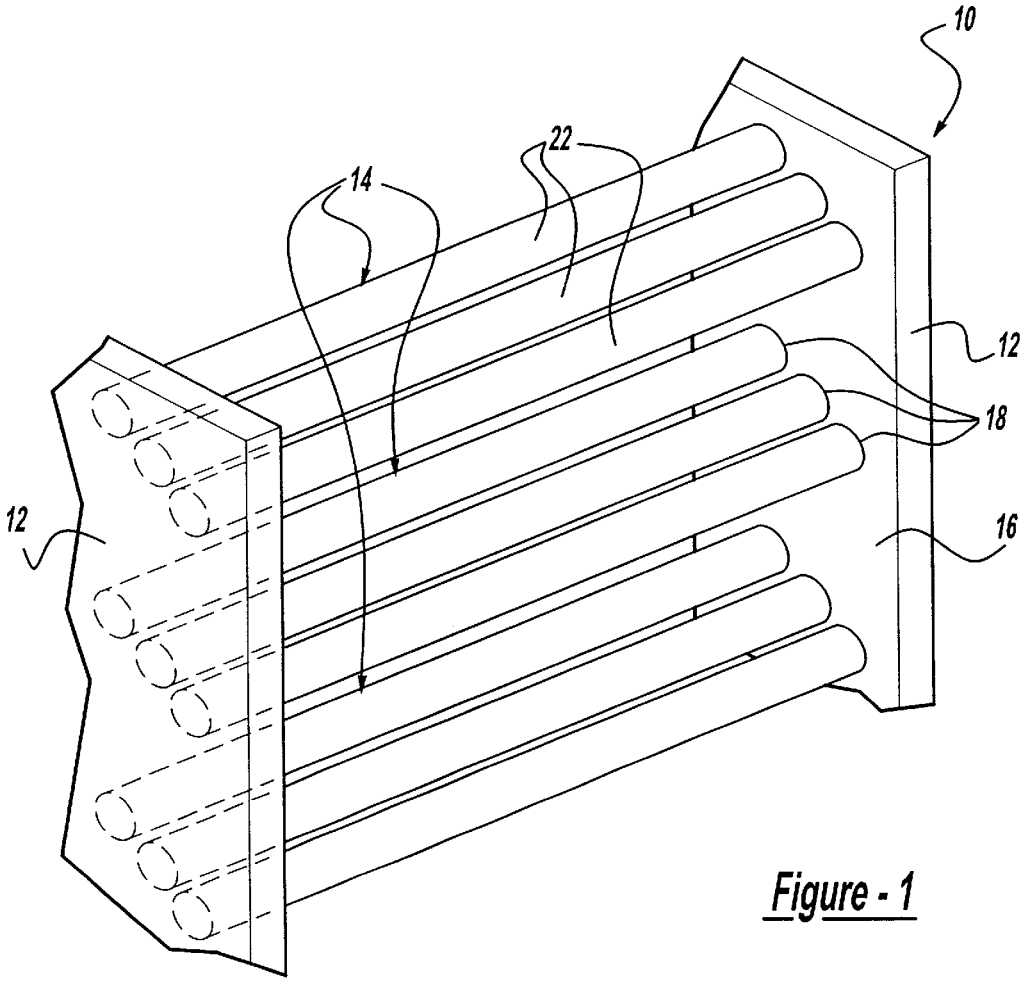
FIG. 1 is a perspective view of a louvered plastic heat exchanger, according to the present invention.
Figure 2:
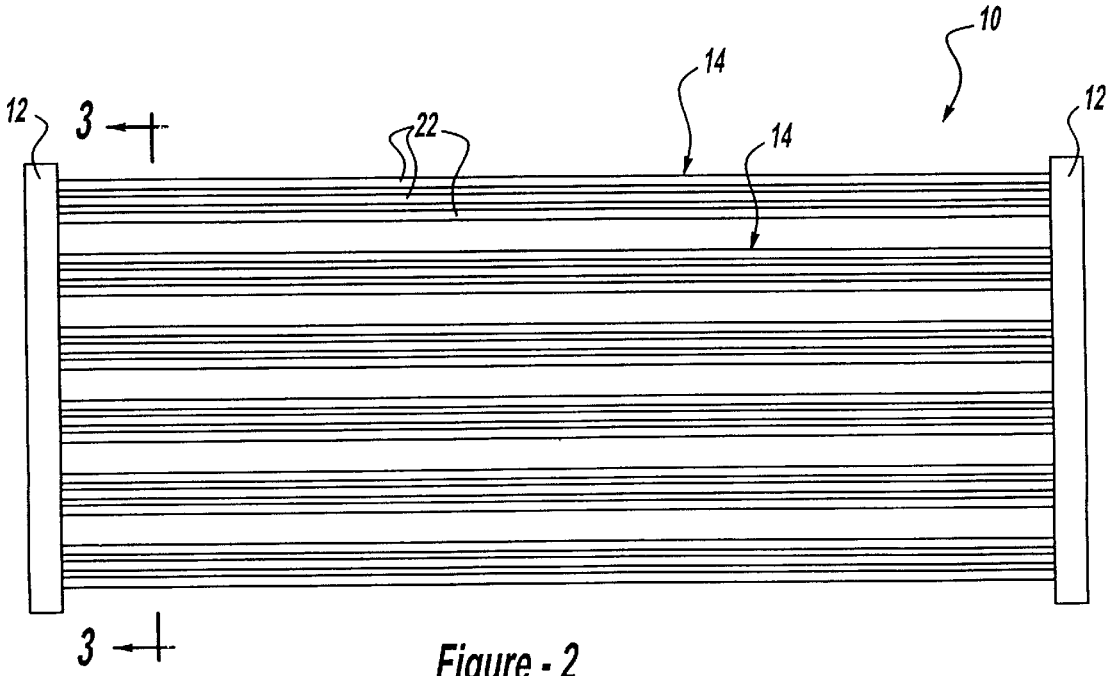
FIG. 2 is an elevational view of the louvered plastic heat exchanger of FIG. 1.
Figure 3:
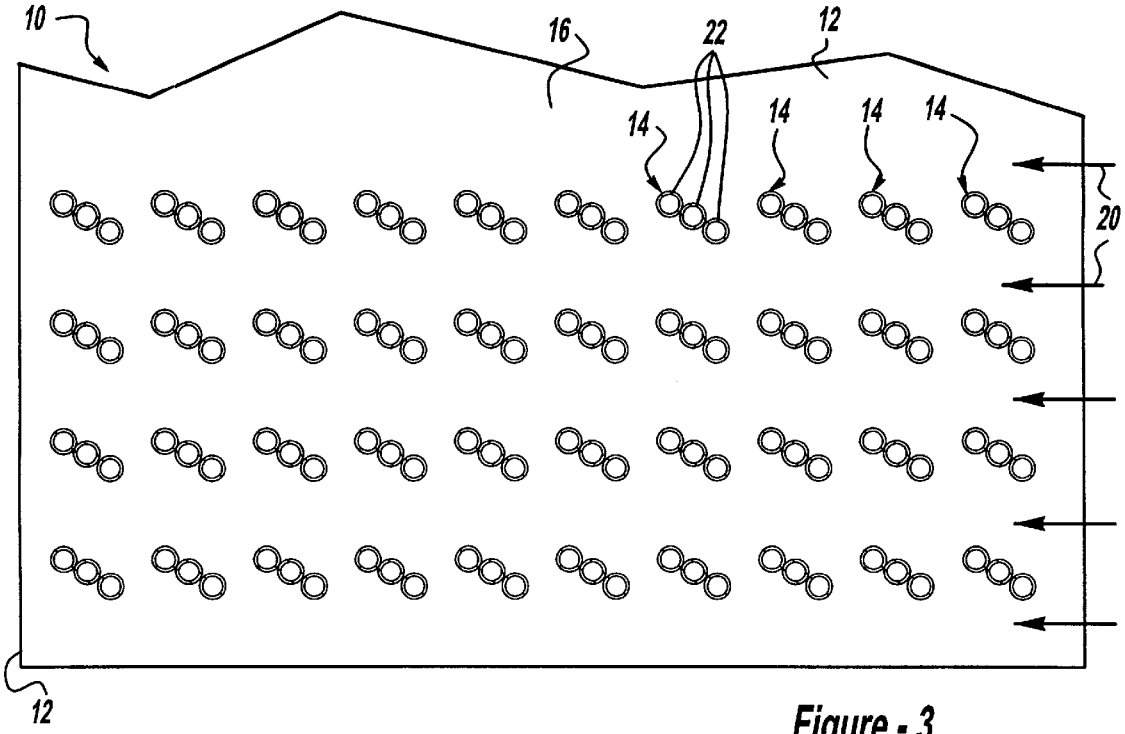
FIG. 3 is a sectional view taken along line 3–3 of FIG. 2.

Referring to the drawings and in particular FIGS. 1 through 3, one embodiment of a louvered plastic heat exchanger 10, according to the present invention, is shown used in a cooling system (not shown) for a motor vehicle (not shown). In the embodiment illustrated, the louvered plastic heat exchanger 10 is a radiator for the cooling system. The louvered plastic heat exchanger 10 includes a pair of generally vertical, parallel manifolds 12 spaced apart a predetermined distance. The louvered plastic heat exchanger 10 also includes a plurality of louvered panels 14 extending between the manifolds 12 and conducting fluid such as a coolant between them. The louvered plastic heat exchanger 10 includes a fluid inlet (not shown) for directing the fluid into the louvered plastic heat exchanger 10 formed in one of the manifolds 12 and a fluid outlet (not shown) for directing the fluid out of the louvered plastic heat exchanger 10 formed in one of the manifolds 12. It should be appreciated that the louvered plastic heat exchanger 10 could be used as a heat exchanger in other applications besides motor vehicles.

As illustrated in FIGS. 1 and 2, the manifolds 12 are generally rectangular in shape and hollow to form an interior chamber (not shown). The manifolds 12 have an inner side 16 with a plurality of apertures 18 extending therethrough and spaced axially to receive one end of the louvered panels 14. The manifolds 12 are made of a plastic material such as nylon. It should be appreciated that the manifolds 12 are conventional and known in the art.

Referring to FIGS. 1 through 3, the louvered panels 14 are evenly spaced laterally and vertically with respect to each other. The louvered panels 14 are positioned at an angle such as twenty-two degrees (22°) off the direction of airflow as indicated by arrows 20 in FIG. 3. The louvered panels 14 form a two dimensional array for the louvered plastic heat exchanger 10. The louvered panels 14 can be spaced to line up exactly between a preceding louvered panel 14 and a proceeding louvered panel 14. It should be appreciated that the core of the louvered plastic heat exchanger 10 is comprised of a two dimensional matrix of the louvered panels 14, evenly spaced, as illustrated in FIG. 3.

The louvered panels 14 have at least one tube 22 extending longitudinally. Preferably, the louvered panel 22 is a plurality of tubes 22, more preferably three tubes 22, which carry fluids such as refrigerant, coolant and air between the manifolds 12. The tube 22 is a relatively thin-walled such as 0.2 millimeters and made of a plastic material such as nylon. The tube 22 has a generally circular in cross-sectional shape. The tubes 22 are formed in groups with a predetermined number of tubes, such as three, in each group. The groups of the tubes 22 are aligned in a row to form the louvered panels 14, which are generally rectangular in shape with a generally rectangular cross-sectional shape. It should be appreciated that the tubes 22 are secured to the inner sides 16 of the manifolds 12 by suitable means such as welding.

In operation, fluid such as a coolant from the cooling system enters the louvered plastic heat exchanger 10 through the inlet on one of the manifolds 12. The fluid passes through the tubes 22 of each louvered panel 14 while airflow 20 passes over the louvered panels 14 for heat transfer therewith to cool the fluid. Once cooled, the fluid exits through the outlet in one of the manifolds 12 and flows to an engine (not shown) of the motor vehicle. It should be appreciated that the number of louvered panels 14 per pass or loop may be varied depending on the performance requirements of the plastic louvered heat exchanger 10 desired.

Figure 4:
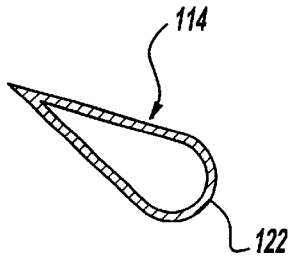
FIG. 4 is an enlarged fragmentary view of another embodiment, according to the present invention, of the louvered plastic heat exchanger of FIG. 1.

Referring to FIG. 4, another embodiment 114, according to the present invention, is shown for the louvered panel 14. Like parts of the louvered panel 14 have like reference numerals increased by one hundred (100). In this embodiment, the louvered panel 114 is a single tube 122 that is similar to a group or row of tubes 22 of the louvered panel 14. The tube 122 has a generally teardrop cross-sectional shape with a single channel extending therethrough. It should be appreciated that the manifolds 12 have similarly shaped apertures to receive the tubes 122.

Figure 5:
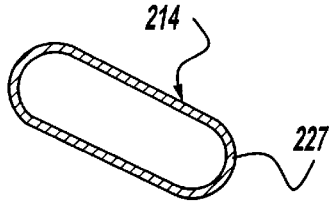
FIG. 5 is a view similar to FIG. 4 of yet another embodiment, according to the present invention, of the louvered plastic heat exchanger of FIG. 1.

Referring to FIG. 5, yet another embodiment 214, according to the present invention, is shown for the louvered panel 14. Like parts of the louvered panel 14 have like reference numerals increased by two hundred (200). In this embodiment, the louvered panel 214 is a single tube 222 that is similar to a group or row of tubes 22 of the louvered panel 14. The tube 222 has a generally oval or rectangular cross-sectional shape with a single channel extending therethrough. It should be appreciated that the manifolds 12 have similarly shaped apertures to receive the tubes 222.

Figure 6:
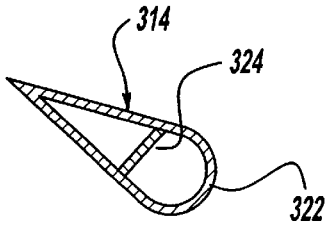
FIG. 6 is a view similar to FIG. 4 of still another embodiment, according to the present invention, of the louvered plastic heat exchanger of FIG. 1.

Referring to FIG. 6, still another embodiment 314, according to the present invention, is shown for the louvered panel 14. Like parts of the louvered panel 14 have like reference numerals increased by three hundred (300). In this embodiment, the louvered panel 314 is a single tube 322 that is similar to a group or row of tubes 22 of the louvered panel 14. The tube 322 has a generally teardrop cross-sectional shape. The tube 322 has an interior wall 324 extending axially therethrough to form a plurality of fluid channels, preferably two. It should be appreciated that the manifolds 12 have similarly shaped apertures to receive the tubes 322.

Figure 7:
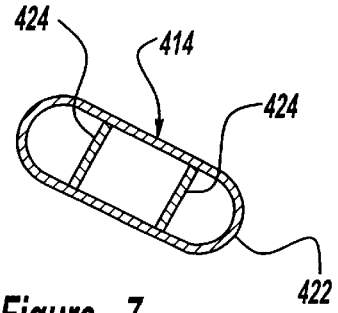
FIG. 7 is a view similar to FIG. 4 of a further embodiment, according to the present invention, of the louvered plastic heat exchanger of FIG. 1.

Referring to FIG. 7, a further embodiment 414, according to the present invention, is shown for the louvered panel 14. Like parts of the louvered panel 14 have like reference numerals increased by four hundred (400). In this embodiment, the louvered panel 414 is a single tube 422 that is similar to a group or row of tubes 22 of the louvered panel 14. The tube 422 has a generally oval or rectangular cross-sectional shape. The tube 422 has a plurality of interior walls 324 extending axially therethrough and spaced radially to form a plurality of fluid channels, preferably three. It should be appreciated that the manifolds 12 have similarly shaped apertures to receive the tubes 422.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A louvered plastic heat exchanger comprising:

a first manifold;

a second manifold spaced from and opposing said first manifold;

a plurality of louvered panels extending laterally between and in fluid communication with said first manifold and said second manifold; and said louvered panels being spaced longitudinally and vertically to allow airflow longitudinally between said louvered panels and to form a two-dimensional array positioned at an angle off a direction of the airflow therethrough.

2. A louvered plastic heat exchanger as set forth in claim 1 wherein said louvered panel comprises at least one tube.

3. A louvered plastic heat exchanger as set forth in claim 2 wherein said at least one tube has a generally circular cross-sectional shape.

4. A louvered plastic heat exchanger as set forth in claim 2 wherein said at least one tube has a generally tear dropped cross-sectional shape.

5. A louvered plastic heat exchanger as set forth in claim 4 wherein said at least one tube has at least one interior wall disposed therein and extending axially therealong.

6. A louvered plastic heat exchanger as set forth in claim 2 wherein said at least one tube has a generally rectangular cross-sectional shape.

7. A louvered plastic heat exchanger as set forth in claim 6 wherein said at least one tube has at least one interior wall disposed therein and extending axially therealong.

8. A louvered plastic heat exchanger as set forth in claim 2 wherein said at least one tube has a plurality of channels formed therein.

9. A louvered plastic heat exchanger as set forth in claim 1 wherein said louvered panels are evenly spaced longitudinally and vertically.

10. A louvered plastic heat exchanger as set forth in claim 1 wherein said louvered panels are aligned between each preceding and proceeding louvered panel.

11. A louvered plastic heat exchanger as set forth in claim 1 wherein said manifolds are made of a plastic material.

12. A louvered plastic heat exchanger as set forth in claim 1 wherein said louvered panels are made of a plastic material.

13. A louvered plastic heat exchanger comprising:

a pair of plastic manifolds being laterally spaced;

a plurality of plastic louvered panels extending laterally between and in fluid communication with said manifolds; and said louvered panels each comprising a plurality of tubes aligned in a row longitudinally, each of said louvered panels being spaced vertically to allow airflow longitudinally between said louvered panels and positioned at an angle off a direction of the airflow therethrough.

14. A louvered plastic heat exchanger as set forth in claim 13 wherein each of said tubes has a generally circular cross-sectional shape.

15. A louvered plastic heat exchanger as set forth in claim 13 wherein each of said tubes has a generally tear dropped cross-sectional shape.

16. A louvered plastic heat exchanger as set forth in claim 15 wherein each of said tubes has at least one interior wall disposed therein and extending axially therealong.

17. A louvered plastic heat exchanger as set forth in claim 13 wherein each of said tubes has a generally rectangular cross-sectional shape.

18. A louvered plastic heat exchanger as set forth in claim 17 wherein each of said tubes has at least one interior wall disposed therein and extending axially therealong.

* * * * *